United States Patent [19]

Lange

[11] Patent Number: 4,982,546

[45] Date of Patent: Jan. 8, 1991

[54] SPACE FRAME NODE

[75] Inventor: Fredric A. Lange, Osseo, Minn.

[73] Assignee: Interlock Structures International, Inc., Maple Grove, Minn.

[21] Appl. No.: 265,713

[22] Filed: Nov. 1, 1988

[51] Int. Cl.[5] ..... E04H 12/00

[52] U.S. Cl. ..... 52/648; 403/174; 403/178

[58] Field of Search ..... 52/648, 81; 403/170, 403/171, 174, 178, 217

[56] References Cited

U.S. PATENT DOCUMENTS

| | | | |
|---|---|---|---|
| 1,679,758 | 11/1923 | Bauersfeld et al. . | |
| 2,195,336 | 3/1940 | Loop | 403/174 X |
| 2,658,776 | 11/1953 | Wilcox | 403/170 X |
| 2,909,867 | 10/1959 | Hobson | 403/174 X |
| 3,157,731 | 11/1964 | Torr . | |
| 3,980,408 | 9/1976 | Sachmann | 403/171 X |
| 4,355,918 | 10/1982 | Van Vliet | 403/170 |
| 4,562,682 | 1/1986 | Arvedi et al. . | |
| 4,637,193 | 1/1987 | Lange | 52/648 |
| 4,776,721 | 10/1988 | Lange | 403/171 |

*Primary Examiner*—David A. Scherbel
*Assistant Examiner*—Creighton Smith
*Attorney, Agent, or Firm*—Merchant, Gould, Smith, Edell, Welter & Schmidt

[57] ABSTRACT

A space frame node including a hub, a facet device, and a transition connector for holding the facet deviced to the hub. For a planar node, the hub is formed by a pair of members fastened together such that receptor cavities are created between them so as to receive transition connectors, generally in the form of bolts. Any of a variety of facet devices are threaded onto the bolts. For a spherical node, three pairs of hub forming members facing one another are joined together at four legs with bolts and facet devices or alternatively nuts. In addition, facet devices may be installed in the intersecting regions of the legs of the hub forming members. These nodes are lightweight, are usable with quick connect/disconnect facet devices as necessary, and result in a reduction of field assembly time of space frame structures.

14 Claims, 3 Drawing Sheets

SPACE FRAME NODE

FIELD OF THE INVENTION

The present invention is directed to space frame structures and, more particularly, to a node which forms the connection among various lattice members of a space frame structure.

BACKGROUND OF THE INVENTION

In general, space frame construction refers to a type of structure wherein a number of lattice members converge and are fastened at a node. By geometrically locating nodes properly, long distances can be spanned with a lighter weight of material while achieving a strength not otherwise possible with such weight of material. In short, space frame construction is intended to provide light weight, high strength, easy to build, inexpensive structures. In many circumstances, space frame construction replaces more traditional structure, such as steel beams, stone or mortar spans, arches, and domes.

Space frame construction has been successful. It has not, however, realized early expectations with respect to being as light weight and as inexpensive as once hoped. Although lattice members are generally light weight and inexpensive, nodes and connections to them are not. A commonly used node is a steel ball machined to have a plurality of facets, usually eighteen, with each facet being tapped to receive a threaded shaft. A common lattice member has a threaded shaft fastened to an end. The lattice member is screwed or threaded into the facet receiving opening. Such node is not only heavy and expensive to make, but assembly of the lattice members to the node is time consuming and must be carefully planned.

Somewhat similarly, U.S. Pat. No. 4,355,918 shows a node formed from three stacked elements held together by a nut and bolt combination. Lattice members having headed ends are received in sockets formed by the elements and are held in place when the nut and bolt combination tightens the stacked elements of the node.

U.S. Pat. No. 4,562,682 shows a node formed from a cup reinforced with a concrete base. The cup supports bolts which are threaded into tapered, threaded ends of lattice members.

Over the years, it has become clear that if space frame construction is to achieve its early expected potential, nodes must be lighter and simpler, and the assembly of the space frame must be sufficiently easy to reduce assembly time relative to traditional span structures.

SUMMARY OF THE INVENTION

The present invention is directed to a node which is light weight and which provides for a variety of different types of facets which will allow quick connect/disconnect thereby reducing field assembly time of a space frame structure. The node of the present invention includes a hub formed by a pair of hub forming members facing one another to form mirror images of one another. The hub has receptor cavities which receive transition connectors. Any one of various facet creating devices may be attached to each transition connector.

Although not truly so limited, in what may be thought of as a two dimensional embodiment, a planar node of the present invention has a hub formed by an identical pair of hub forming members which are fastened with a nut and bolt combination to one another.

The members are stamped from flat metallic sheets to include openings for receiving the heads of bolts and complementary semi-cylindrical formations for receiving the shanks of the bolts such that the bolts extend radially outwardly from the center axis of the hub. Facet devices are threaded onto the shanks of the bolts.

In a more three dimensional or spherical embodiment, three pairs of hub forming members are fastened together with each pair centered on an axis such that the axes are orthogonal. Each hub forming member has first and second pairs of legs with the first pair being perpendicular with respect to the second pair. The hub forming members are fastened together at the ends of the legs with a bolt such that either or both a nut and a facet creating device are threaded onto the bolt. Additionally, a facet may be formed at the intersection of each pair of legs of each hub forming member by using another bolt and facet creating device.

The node embodiments of the present invention are particularly light weight and are particularly inexpensive to manufacture. With respect to the planar embodiment, the hub forming members are stamped, and yet are made sufficiently strong for any particular application. Only the material needed is used. With respect to the spherical embodiment, the hub forming members are cast or stamped, and the resulting hub is hollow. The hub forming members are designed sufficiently strong for desired applications.

Although the present invention achieves the objective of reducing weight to a minimum without requiring an expensive manufacturing process, the most startling advantage of the present node is realized when it is used to assemble an actual space frame structure. The hub of the present invention has receptor cavities which receive bolts. Any of a variety of facet creating devices are easily threaded onto as many bolts as needed as a part of the node manufacture, if desired, to create the facets needed. In this regard, various quick connect/disconnect facet devices are disclosed in detail in U.S. Pat. No. 4,637,193, U.S. Pat. No. 4,775,258, U.S. Pat. No. 4,776,721, and U.S. Pat. application Ser. No. 162,984 filed Mar. 2, 1988. In this way, attachment of lattice members to the node is accomplished quickly. Thus, labor is shifted from field assembly which with the prior art required screwing of the node or the lattice member, but with the present invention allows for a quick/disconnect facet to lattice member connection, to manufacturing assembly where conditions are standardized so that costs are minimized.

In short, the present invention truly achieves reduced node material and consequently weight, properly engineered strength for the span desired, and reduced construction expense due largely to a shifting of labor from assembly toward manufacture where conditions and procedures can be standardized and costs minimized.

These advantages will be better understood by reference to the drawings briefly described hereinafter and the detailed description of the invention following thereafter.

DETAILED DESCRIPTION OF THE PREFERRED EMBODIMENT

Figure 1:
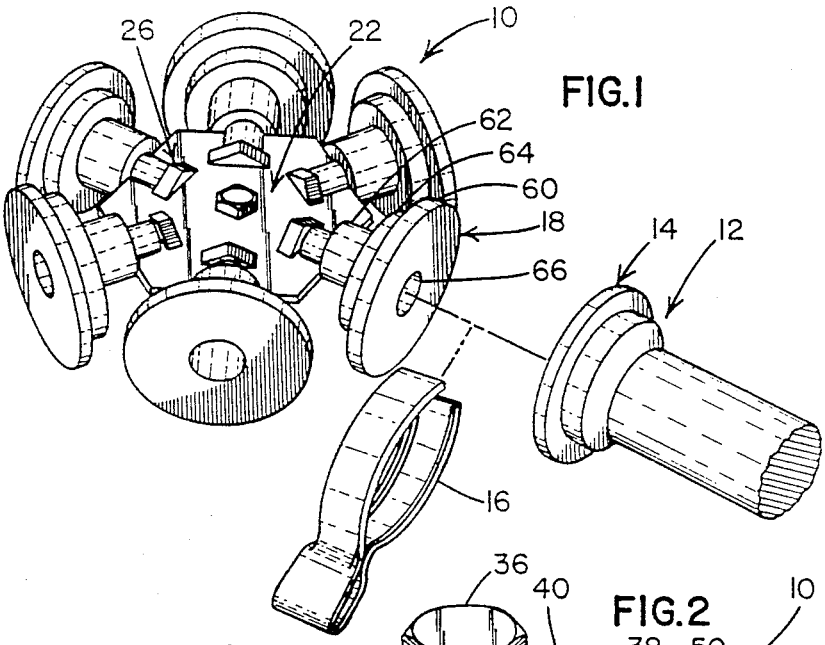
FIG. 1 is a perspective view of a planar node showing a lattice member and quick connect/disconnect assembly exploded therefrom.

Referring now to the drawings wherein like reference numerals designate identical or corresponding parts throughout the several views, and more particularly to FIG. 1, a space frame planar node in accordance with the present invention is designated generally by the numeral 10. A lattice member 12 is shown with an appropriate end member 14 for connection with fastener 16 to one of the facet devices 18 of node 10.

Node 10 is assembled to have a hub 22. Hub 22 includes a plurality of receptor cavities 24 which are formed to receive transition connectors 26. A facet device 18 is attached to a transition connector 26 at as many locations as desired so as to create a multiple facet node.

Figure 2:
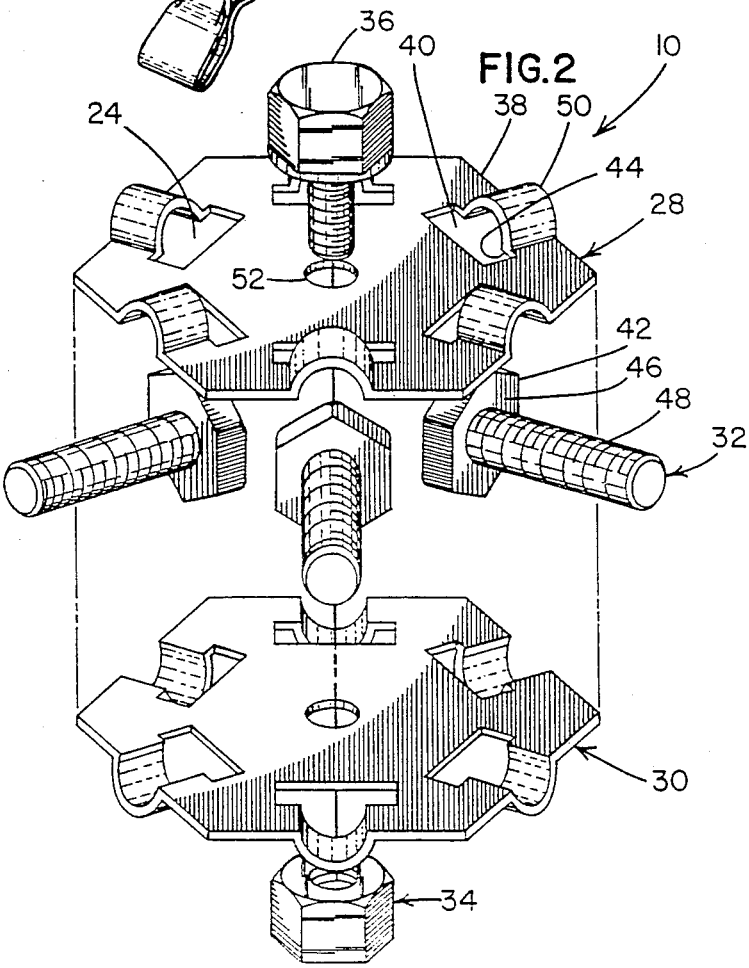
FIG. 2 is an exploded, perspective view of the planar node.
Figure 3:
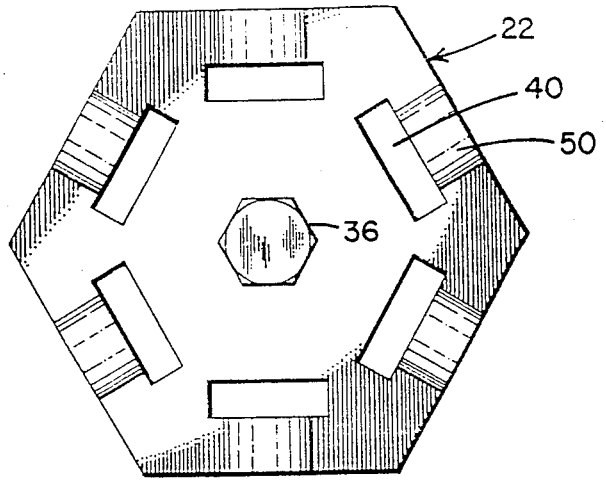
FIG. 3 is a plan view of the hub of the planar node; forming member.
Figure 4:
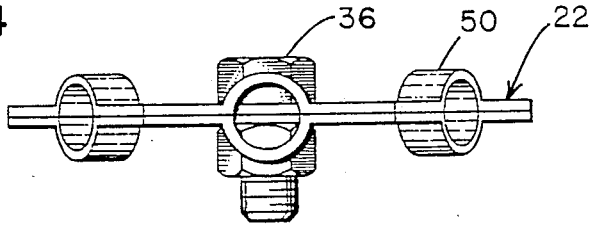
FIG. 4 is a side view of the planar node hub of FIG. 3.

Node 10 is shown more particularly in exploded form, although without facet devices 18, in FIG. 2. Node 10 includes a pair of hub forming members 28 and 30 with transition connectors in the form of bolts 32 held between members 28 an 30. A nut 34 and bolt 36 combination fastens members 28 and 30 together. Other fastening mechanisms, such as, rivets, may also be used.

Hub forming members 28 and 30 are identical and are arranged to face one another to form mirror images of one another. Member 28 is typical. Member 28 is preferably stamped from a flat metallic sheet. Member 28 has a plurality of flat edges 38, preferably arranged in a regular pattern like a hexagon. Member 28 also has a plurality of openings 40 shaped to receive the head 42 of bolt 32. Each of openings 40 has a side 44 parallel with an edge 38. Side 44 contacts the end 46 of head 42 to which the shank 48 of bolt 42 connects. When a facet 18 is threaded onto shank 48, facet 18 generally tightens to edge 38, and it is generally desireable that the contact surface between the hub and the facet be perpendicular to the axis of the connector and facet. A semi-cylindrical formation 50 is formed between each set of edge 38 and opening 40 having a side 44 which is parallel to the edge 38. Formation 50 has a radius such that when hub forming members 28 and 30 are fastened together, a shank 48 of a bolt 42 fits snugly therebetween. Thus, a pair of aligned openings 40 and the cylindrical cavity formed by a complimentary pair of semi-cylindrical formations 50 form a receptor cavity for receiving a transition connector, namely a bolt 32 as shown in the present embodiment.

Hub forming members 28 and 30 also each include an opening 52 centered on the center line of the items. Openings 52 are formed to receive the shank of bolt 36 thereby allowing the nut 34 and bolt 36 combination to fasten members 28 and 30 together. It is noted that openings 52 may also be considered to be a receptor cavity with bolt 36 a transition connector whereby a facet may be fastened thereto. In this case, a nut may be used, but is not necessary since the facet provides the clamping mechanism for holding members 28 and 30 together. It is further observed that a threaded rod can be used in place of bolt 36 with facets threaded on opposite sides of members 28 and 30 and clamping members 28 and 30 therebetween to hold them together.

Figure 5:
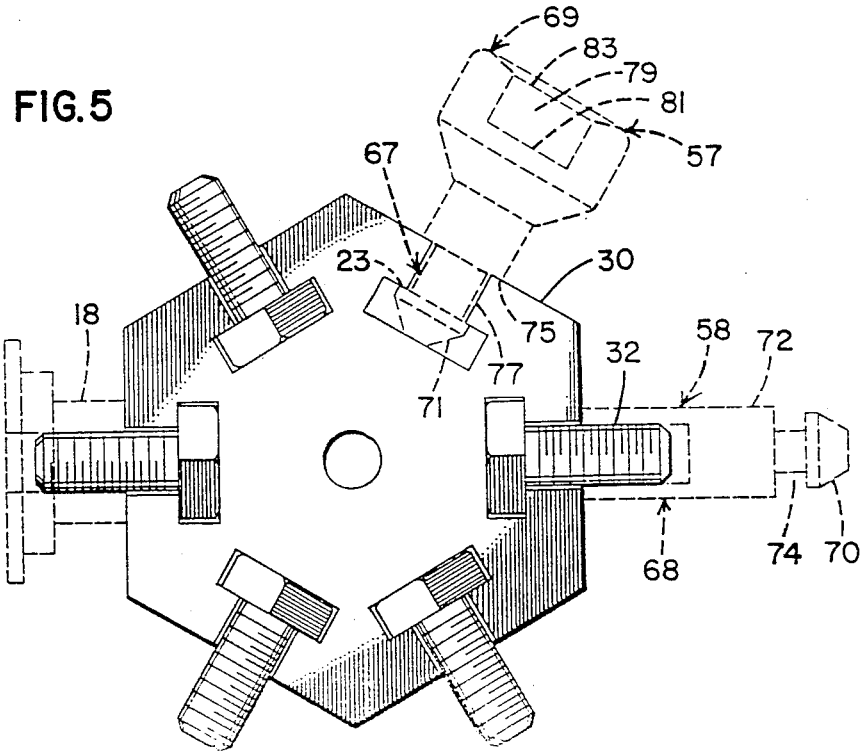
FIG. 5 is a plan view of a hub forming member showing bolts fitted therein in solid lines and exemplary facet devices in broken lines.
Figure 6:
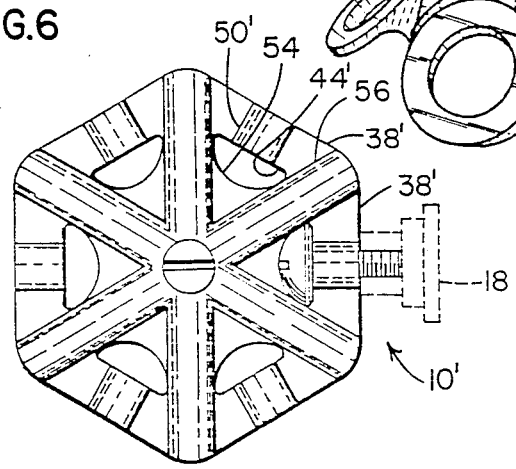
FIG. 6 is a plan view of an alternate embodiment of the planar node.
Figure 7:
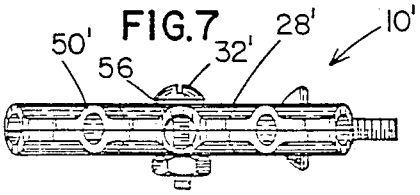
FIG. 7 is a side view of the planar node of FIG. 6.

In an alternate embodiment as shown in FIGS. 6 and 7, the same elements as shown in the first embodiment of FIGS. 1–5 are designated by the same numerals, only the numerals are primed. Node 10′ is the preferred embodiment. Node 10′ has all the same elements as node 10, except openings 40 have an arcuate side 54 opposite straight side 44′ to conform more closely to the rounded head of a screw 32′ which is used in place of bolt 32. In addition, strengthening formations 56 are formed in each of hub forming members 28′ and 30′. Strengthening formations 56 extend radially from the center of member 28′ to an intersection of adjacent straight edges 38′. Strengthening formations 56 are preferably arcuate outwardly and may be semi-cylindrical similar to semi-cylindrical formations 50 in node 10 and 50′ in node 10′.

A representative facet device 18 is shown in FIG. 1. It is also shown in broken lines in FIG. 5, along with a second representative facet device 58. Facet device 18 is formed as a flat disc 60 with a boss 62 extending in one direction therefrom. Supporting structure 64 strengthens disc 60. Hub 62 has an axial tapped opening so that facet device 18 can be threaded onto bolt 32. A similar facet device 18 is shown attached to all transition connectors of node 10 in FIG. 1. It is understood that only as many facets and transition connectors as are needed for a particular space frame structure need to be assembled to hub 22 in order to form a node 10. In this way, the number of parts are reduced, assembly effort is less, weight is reduced, and cost is less.

End member 14 is configured similar to a facet device 18. End member 14 is preferably welded to the end of lattice member 12. A bolt (not shown) is threaded into the tapped axial opening of end member 14 so that the head of the bolt can fit into cavity 66 centered in the facing end of facet device 18 thereby aligning lattice member 12 with facet device 18. A spring clip 16 is formed to fit over the disc portions 60 of facet device 18 and end member 14 to hold them together thereby attaching lattice member 12 to node 10. The connector formed by facet device 18, end member 14 and spring clip 16 is described in greater detail in U.S. Pat. No. 4,776,721 which is incorporated herein by reference.

Facet device 57 (see FIG. 5) includes a transition connector portion 67 and a facet portion 69. Transition connector portion 67 is formed to have a head 71 with a ring-shaped flat surface 73 facing facet portion 69. Head 71 is separated from a second ring-shaped surface 75 on facet portion 69 by a cylindrical neck 77. Facet portion 69 includes a cradle 79 having a wall 81 on one side and a lip 83 on the opposing side. The cradle is shaped to receive rather snugly a flange-like button (not shown) attached to a lattice member (not shown) as described in greater detail in U.S. Pat. No. 4,637,193 and U.S. Pat. No. 4,775,257, both of which are incorporated herein by reference. It is understood that the transition connector 67 of facet device 57 may be used with respect to any facet device thereby replacing bolt 32.

Facet device 58 (see FIG. 5) is a cylindrical rod 68 having a tapped end which threads onto bolt 32. The other end of rod 68 has a tapered head 70 spaced from the central portion 72 by a cylindrical groove 74. The lattice member having a mating connecting portion for locking onto facet 58 is not shown herein, but is described in detail in U.S. Pat. application 162,984 filed Mar. 2, 1988 herein incorporated by reference.

In use, node 10 is assembled by placing as many bolts 32 in the partially formed receptor cavities of inverted hub forming member 30 as needed, as shown in FIG. 5. Hub forming member 28 is then placed over bolts 32. Nut 34 and bolt 36 combination is next installed in openings 52 to fix hub forming members 28 and 30 together thereby forming hub 22 and locking bolts in place. Facets of the particular type desired are then threaded onto bolts 32. It is noted that if openings 40 are sized to snugly receive heads 42 of bolts 32, the bolts will be secured from rotating while a facet is screwed thereon.

Figure 8:
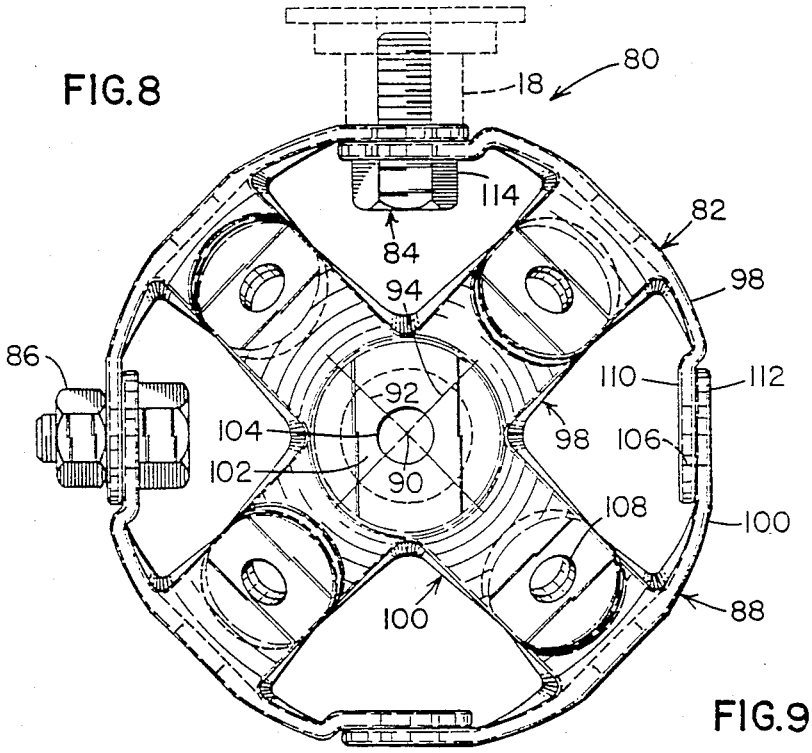
FIG. 8 is a side view of a spherical node in accordance with the present invention.
Figure 9:
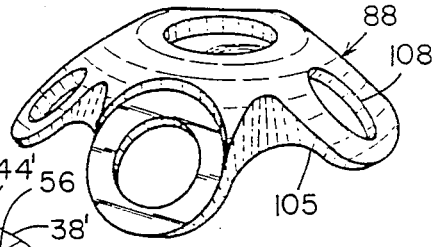
FIG. 9 is a perspective view of a hub forming member for a spherical node.

Node 10 forms a hub which is aligned along a plane, and the axes of all the facets generally lie in or parallel with such plane. Although a facet device may be attached to bolt 36 or two facet devices may be attached to a threaded rod used in place of bolt 36, node 10 is predominantly a planar node. Node 10 as shown is preferably intended for two to six facets, although another two are possible as indicated by replacing bolt 36 with a threaded rod. It is understood that planar nodes having other shapes, for example, rectangular, octagonal, etc., would have other possibilities for preferred and possible numbers of facets. In a further embodiment shown, a spherical node for forming up to eighteen facets can be assembled on the basis of a design concept similar to node 10. Spherical node 80 is shown in FIG. 8.

Node 80 includes a hub 82 with a plurality of transition connectors in the form of bolts 84 having either facet devices 18, for example, or nuts 86 thereon to hold the hub forming members 88 together. Hub 82 is created from three pair of hub forming members 88. Other spherical nodes may have a different number of hub forming members. Each pair is centered on a different axis 90, 92, and 94, the axes forming an orthogonal set. Each pair of hub forming members 88 face one another and form mirror images of one another. Each hub forming member 88 includes first and second pairs of legs 98 and 100, wherein legs 98 are aligned perpendicular to legs 100. Hub forming members in other spherical nodes may have legs, which are not perpendicular to one another. The first and second pairs of legs 98 and 100 intersect in an intersecting region 102 which includes a receptor cavity in the form of an opening 104. A rib 105 may be formed along portions of legs 98 and 100 and joined at intersecting region 102 to add strength to hub 82. Each of legs 98 and 100 out near the ends thereof also include openings 106 and 108, respectively. The hub forming members 88 have an outer convex surface, which when the several hub forming members are fastened together, becomes a part of a spherical surface. In this regard, the end portions 110 of the first pair of legs 98 are depressed from the convex surface so as to fit under legs 100 of adjacent members 88. End portions 110 of legs 98 and 112 of legs 100 are flat so as to fit together and so as to provide flat surfaces against which the head 114 of bolt 84 and the contact surface of facet device 18 may be tightened. The aligned openings 106 and 108 in adjacent legs 98 and 100 form a receptor cavity. The shank of bolt 84 fits through the receptor cavity and is engaged by either a nut 86 or a facet device such as facet device 18. Although only one of each of such combinations is shown in FIG. 8, it is understood that node 80 includes one of such combinations at each location of adjoining legs 98 and 100 of adjacent hub forming members 88. There are, thus, twelve such locations, each such location, as indicated, may be either a fastening joint or become a facet for the node. In addition, six facets may be formed at the various openings 104.

In use, node 80 is assembled by locating an end portion 110 of a leg 98 beneath an end portion 112 of a leg 100 of adjacent hub forming members 88. A bolt 84 is installed with a shank extending outwardly through aligned openings 106 and 108. A nut 86 or a facet device of an appropriate type is threaded onto bolt 84. A similar procedure is used for the six hub forming members to complete the hub 82. Alternatively, openings 106 and/or 108 may be tapped. It is also understood that a rivet could replace any nut and bolt combination used only for fastening. If additional facets are needed at any of the locations of openings 104, a bolt and facet device is similarly installed at such locations. Lattice members are attached to the various facets using an appropriate mating part as described hereinbefore.

Each hub forming member 88 may be made of appropriate strength so that node 80 has strength for any particular space frame structure. At the same time, node 80 is hollow and includes cut out portions between the various legs so that it is as light weight as possible. Furthermore, node 80 may be assembled at a factory with node devices which allow quick connect/disconnect to lattice members at field locations. Thus, field assembly is minimized while factory assembly is kept simple and routine. Total assembly time and cost is generally reduced. In short, node 80 may include as few or as many facets as needed for a particular application and, thus, provides versatility and a further feature for controlling costs and complexity. Node 80 achieves the objectives which had been originally expected for space frame construction.

Finally, although the various embodiments of the space frame node in accordance with the present invention have been described in detail and the advantages of structure and function set forth, it is understood that equivalents are possible. Consequently, any changes made in structure, especially in matters of shape, size and arrangement, to the full extent extended by the general meaning of the terms in which the appended claims are expressed, are understood to be within the principle of the present invention.

What is claimed is:

1. A space frame node having a facet, comprising:

a hub including a pair of hub forming members facing one another to form mirror images of one another and means for fastening said hub forming members together, said hub including a receptor cavity, said hub including a plurality of pairs of hub forming members, each of said pairs being centered on a different axis, said axes being non-parallel;

means for creating said facet; and a transition connector connecting said hub and said facet creating means, said transition connector being received in said receptor cavity.

2. The node in accordance with claim 1 wherein each of said hub forming members includes first and second pairs of legs, said first pair of legs being aligned perpendicular to said second pair of legs.

3. The node in accordance with claim 2 wherein said first and second pairs of legs form an intersecting region, said intersecting region including said receptor cavity.

4. The node in accordance with claim 2 wherein each of said legs includes an opening, said receptor cavity being formed by a pair of aligned, adjacent said openings in adjacent said hub forming members.

5. The node in accordance with claim 4 wherein each of said hub forming members have an outer convex surface, said first pair of legs having end portions depressed from said convex surface, said convex surfaces being a part of a spherical surface.

6. The node in accordance with claim 1 wherein said transition connector includes a bolt.

7. The node in accordance with claim 6 wherein said fastening means includes a nut threaded onto said bolt.

8. The node in accordance with claim 1 wherein each of said hub forming members is stamped from a flat metallic sheet.

9. A space frame node having a facet, comprising:

a hub including a pair of hub forming members facing one another to form mirror images of one another and means for fastening said hub forming members together, said hub including a receptor cavity, each of said hub forming members including a plurality of flat edges and openings, each of said openings having a side parallel with one of said edges, each of said hub forming members further including connector receiving formations between said edges and said sides parallel;

means for creating said facet; and a transition connector connecting said hub and said facet creating means, said transition connector being received in said receptor cavity.

10. The node in accordance with claim 10 wherein each of said hub forming members also includes a strengthening formation between adjacent said connector receiving formations.

11. A space frame node having a facet, comprising:

a hub formed by a plurality of hub forming members, each of said hub forming members including a central region and a plurality of legs extending therefrom, each of said legs of said hub forming members being fastened to an adjacent one of said legs of an adjacent one of said hub forming members;

means for creating said facet; and means for fastening said facet creating means and said hub together.

12. A space frame node having a facet comprising:

a hub formed by a pair of hub forming members and means for fastening said hub forming members together, said hub forming members including a plurality of sets of an edge and an opening with a semi-cylindrical formation extending between said edge and said opening, said hub forming members further including a plurality of strengthening formations with one of said strengthening formations being between each pair of adjacent sets of edges and openings;

a bolt having a head and a shank, said head being received in an aligned pair of openings in said hub forming members and said shank being received between facing semicylindrical formations; and means for creating a facet, said facet creating means being threaded onto the shank of said bolt.

13. A space frame, comprising:

a node including a hub including a pair of hub forming members facing one another to form mirror images of one another, said hub also including a receptor cavity, said hub further including a weight reducing opening which exposes a portion of said engaging means of said facet creating means, said node further including means for creating a facet external of said receptor cavity, said facet creating means including means for engaging said receptor cavity, said node also including means for fastening said hub forming members together;

a lattice member with means for mating with said facet; and means for nonrotatably connecting said facet and said mating means together.

14. A method for making a space frame node, comprising the steps of:

installing a plurality of transition connectors with respect to hub forming members;

fastening said hub forming members together to secure said transition connectors and to form a hub; and after fastening said hub forming members together, installing facet creating members onto at least some of said transition connectors.

* * * * *